US010965000B2

(12) United States Patent
Stekr et al.

(10) Patent No.: US 10,965,000 B2
(45) Date of Patent: Mar. 30, 2021

(54) ANTENNA MOUNTING SYSTEM

(71) Applicant: PerfectVision Manufacturing, Inc., Little Rock, AR (US)

(72) Inventors: Scott Stekr, Littleton, CO (US); Douglas Salvatori, Minooka, IL (US)

( * ) Notice: Subject to any disclaimer, the term of this patent is extended or adjusted under 35 U.S.C. 154(b) by 0 days.

(21) Appl. No.: 16/289,591

(22) Filed: Feb. 28, 2019

(65) Prior Publication Data

US 2019/0267696 A1 Aug. 29, 2019

Related U.S. Application Data

(60) Provisional application No. 62/636,518, filed on Feb. 28, 2018.

(51) Int. Cl.
*H01Q 1/12* (2006.01)

(52) U.S. Cl.
CPC ..... *H01Q 1/1207* (2013.01); *H01Q 1/1228* (2013.01)

(58) Field of Classification Search
CPC ..... H01Q 1/1207; H01Q 1/1228; E04G 7/02; Y10T 403/39
See application file for complete search history.

(56) References Cited

U.S. PATENT DOCUMENTS

| | | | | |
|---|---|---|---|---|
| 9,634,373 | B2 * | 4/2017 | Lee | H01Q 1/1228 |
| 2016/0211569 | A1 * | 7/2016 | Skrepcinski | H01Q 1/1228 |
| 2016/0294036 | A1 * | 10/2016 | Christie | H01Q 1/1228 |
| 2017/0264005 | A1 * | 9/2017 | Roy | H01Q 1/1228 |

* cited by examiner

*Primary Examiner* — Daniel D Chang
(74) *Attorney, Agent, or Firm* — David Gershner

(57) ABSTRACT

An antenna mounting system configured to be attached to the structure of a communications tower and to connect with additional mounting systems located adjacent on the tower. The system is secured to the tower structure via a multi piece clamp configured to attach to tower elements of varying sizes and shapes and which may be joined together with one or more adjacent mounting systems. Single piece side frames with X shaped central bracing are attached to the mounting clamp and further attached to multiple face members. The face members are used to attach members which serve as the ultimate mounting points for antenna equipment as well as members to brace the mounting system to the tower structure or an adjacent mounting system. The system further incorporates a dedicated anchor point for fall arrest equipment used by tower technicians.

20 Claims, 5 Drawing Sheets

ANTENNA MOUNTING SYSTEM

PRIORITY CLAIM

This utility patent application is based upon and claims priority from previously filed U.S. Provisional Patent application entitled "Antenna Mounting System," bearing application No. 62/636,518 filed on Feb. 28, 2018 by inventors Scott Stekr and Douglas Salvatori.

FIELD OF THE INVENTION

The present invention relates generally to mount or brackets for antenna components. More particularly, the present invention relates to mounts and brackets which facilitate the attachment of antennas or related components to wireless communication towers or other similar structures

BACKGROUND OF THE INVENTION

Wireless data and voice communications services have become ubiquitous in modern society. In order to transmit the signals necessary to facilitate these services, there is a need for antennas to both transmit and receive the wireless signals. These antennas must be situated high above the ground and properly positioned in order to optimize signal transmission. Additionally, because of the increasing utilization of wireless communications, the number of antennas used per tower is increasing, as are the size of the antennas being mounted.

With the increasing number of antennas being used, the efficient configuration of them has become more important. Further, the increasing size and weight of the antennas being attached places a greater importance on the integrity and stability of the mounting system for purposes of both safety and signal quality.

Additionally, there is an inherent risk in the installation and maintenance of the antennas and mounts as they are typically located on towers high above the ground. Accordingly, it is desirable to provide a mount system which both minimizes a worker's time on the tower as well as one which provides dedicated locations for the attachment of safety lines and harnesses.

SUMMARY OF THE INVENTION

The present invention is a system for mounting wireless communication antennas to tower structures. The system consists of a clamp for attaching to the tower structure, side frame members, face support members, antenna attachments members, bracing arms, and a safety anchor. The invention also consists of tying members through which three mounts may be connected together in a 360 degree, triangular configuration.

The object of the present invention is to provide a mounting system for attaching wireless antennas and related components to a tower or similar structure. The system may be used singularly or may be combined with two additional units in a three sided, 360 degree configuration.

It is a further object of this invention to provide a system of multiple antenna mounts which are rigidly connected together at points adjacent to location at which the mounts attach to the tower for added stability of the mounting systems.

It is a further object of this invention to provide a mounting system for which the mounting bracket which attaches to the tower structure is configured in such a way to accommodate and firmly attach to tower members of multiple shapes and sizes.

It is a further object of this invention to provide a mounting bracket which is adjustable in multiple directions and which may be adjusted after the bracket is firmly secured to the tower structure.

It is a further object of this invention to provide an antenna mounting system with a dedicated anchor point for the attachment of technician safety equipment.

It is a further object of this invention to provide an antenna mounting system which is simple to manufacture, stronger than existing systems, and which is simple to assemble in the field by the installer.

The advantages of the present invention include that it is adaptable to many shapes and sizes of tower structure, imparts less stress on tower components, is simple to manufacture and assemble, and provides a dedicates safety anchor for tower technicians.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE PREFERRED EMBODIMENT

Figure 1:
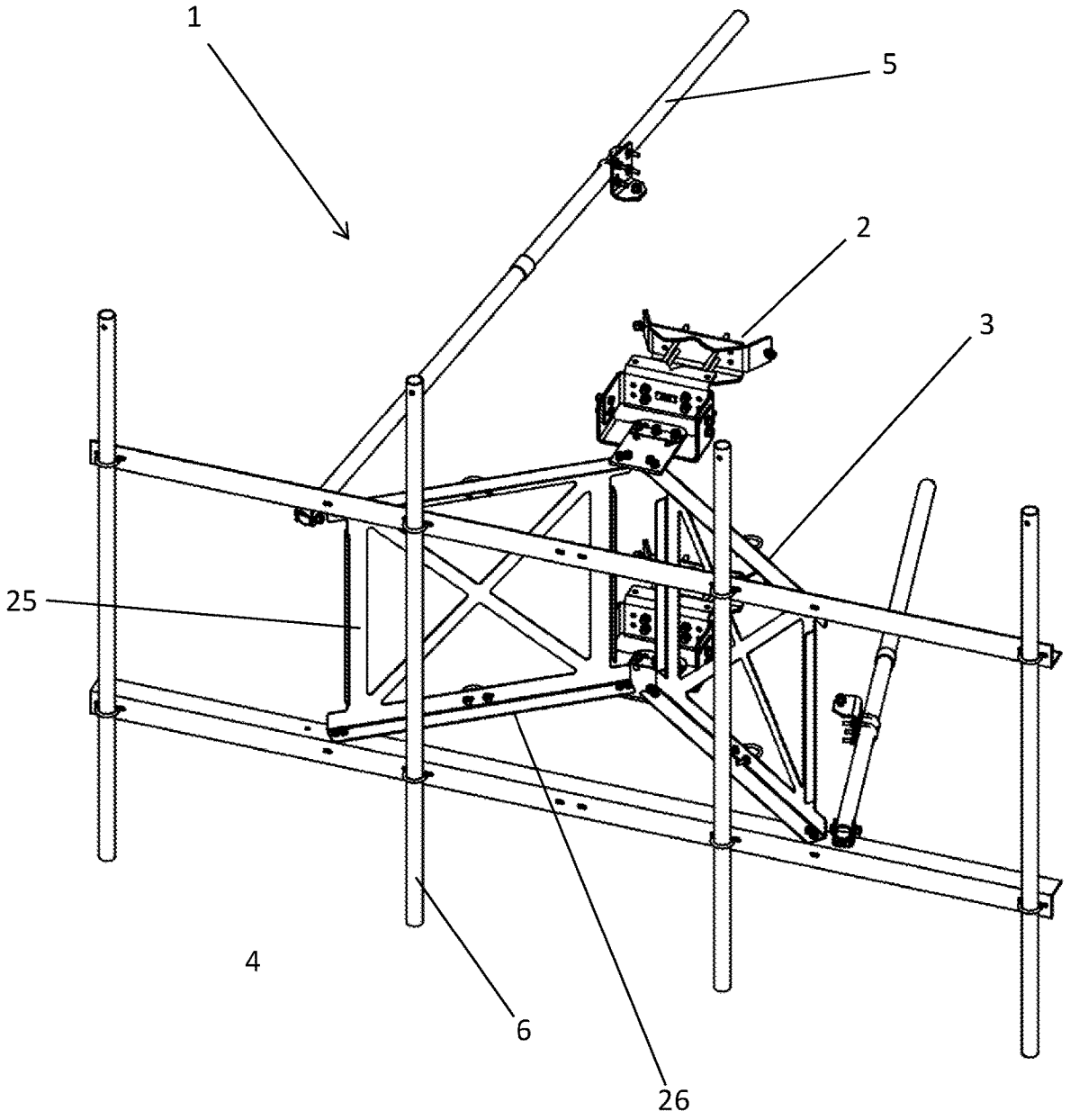
FIG. 1 is a frontal isometric view of a single mounting system.
Figure 2:
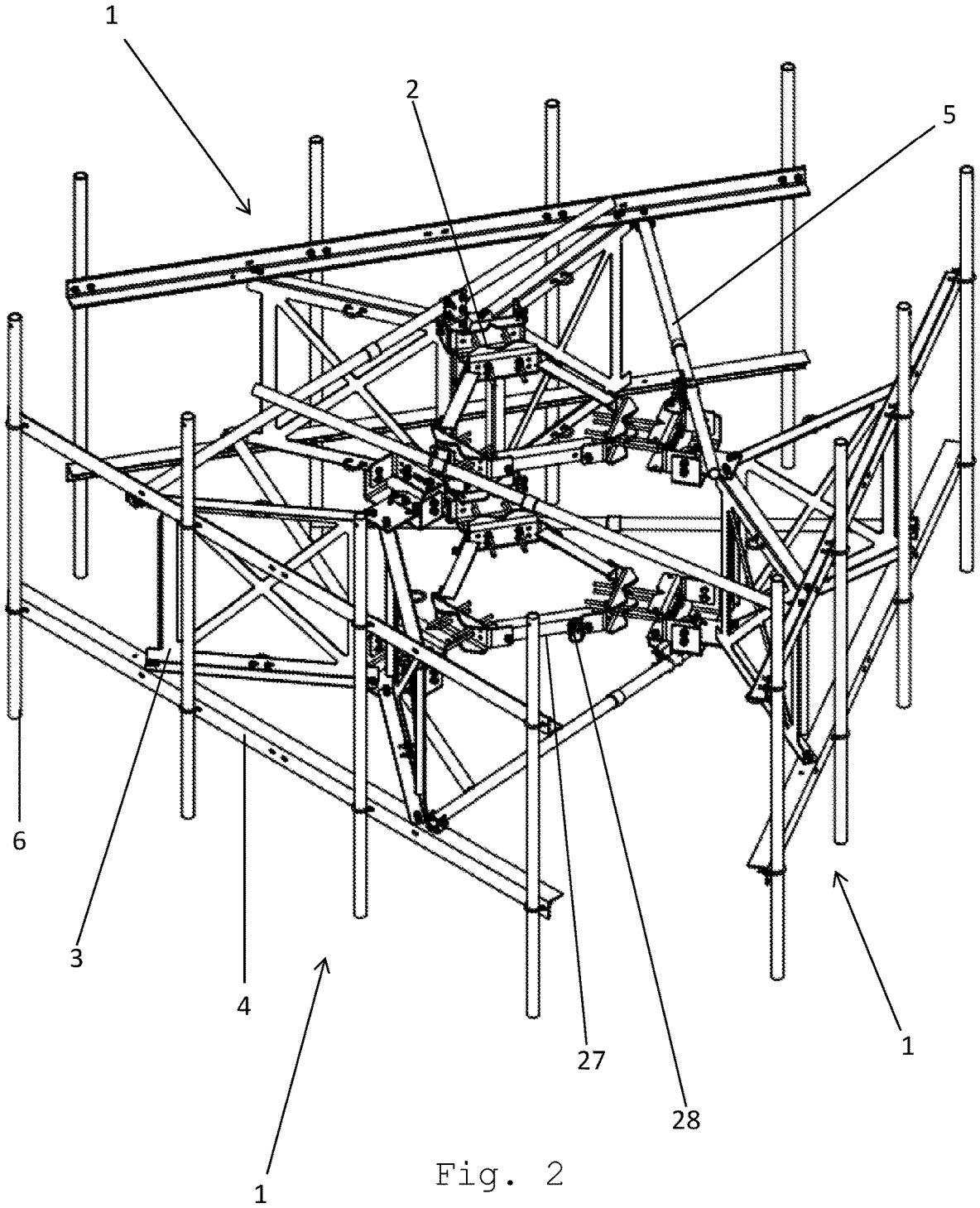
FIG. 2 is an isometric view of three mounting systems attached and configured in a 360 degree orientation.

Referring to the drawings, FIGS. 1 and 2 depict an antenna mounting system 1 featuring two mounting clamps 2, two side frames 3, two face members 4, a plurality of bracing arms 5, and a plurality of attachment members 6. Referring specifically, to FIG. 2, multiple mounting systems may be attached together via tying members 27 which attach the systems' mounting clamps 2.

Figure 3:
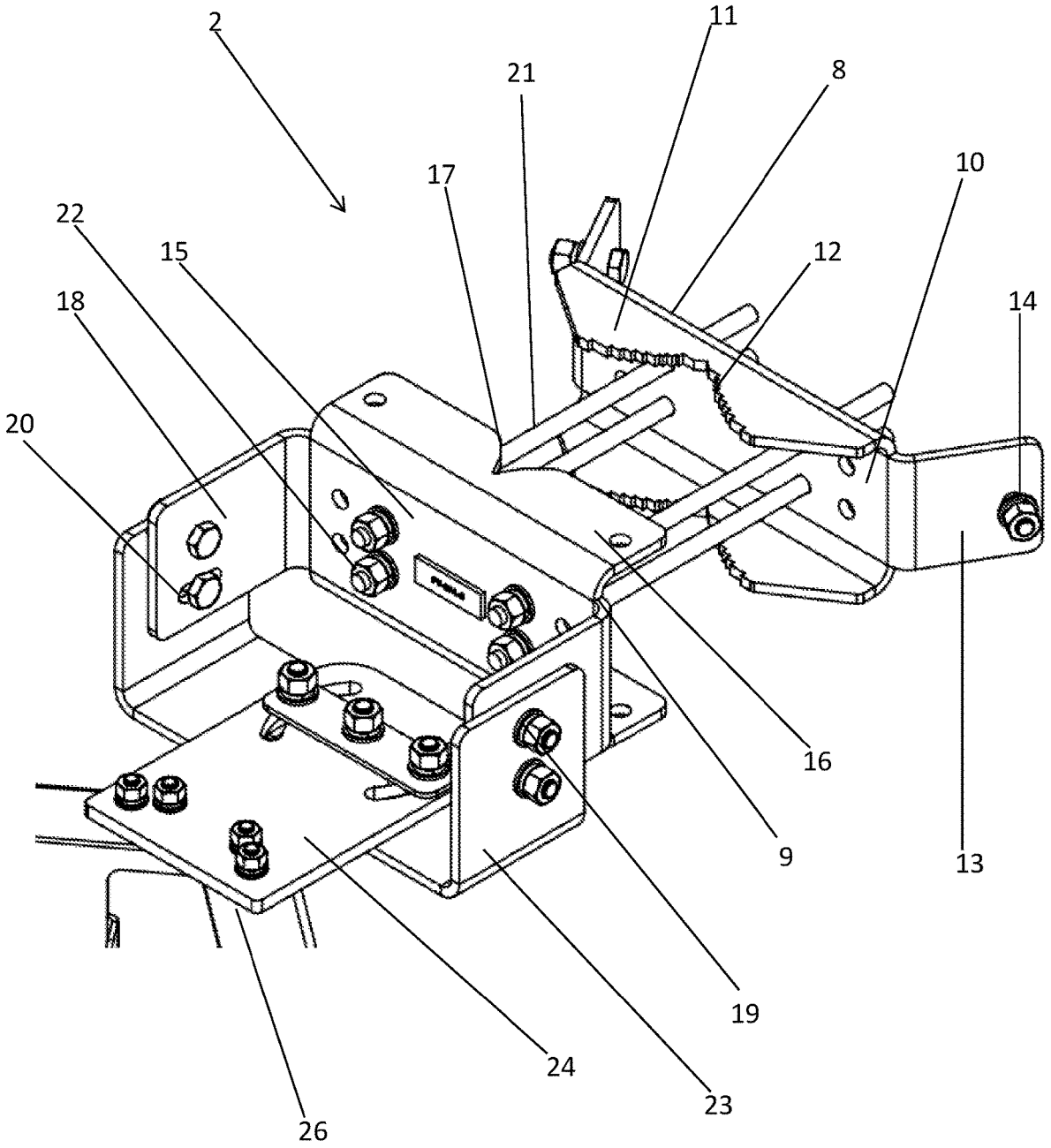
FIG. 3 is a front isometric view of the mounting clamp.

Referring to the drawings, FIG. 3 depicts the mounting clamp 2 in its pre-assembled state. The mounting clamp comprises a rear clamping component 8 and a front clamping component 9. The front and rear clamping components are preferably made of metal. The rear clamping component 8 comprises two rear tower contact lobes 11 which extend perpendicular from the main plane 10 of the rear clamping component 8 and extend axially toward the front clamping component 9 when the mounting clamp 2 is in its pre-assembled state. The rear tower contact lobes 11 feature a serrated notch 12 configured to contact and grip the tower structure to which the mounting clamp 2 is attached. The rear clamping component 8 also features tying tabs 13 located on each end of the rear clamping component 8. The tying tabs 13 are configured at a 120 degree angle from the main plane 10 of the rear clamping component 8 and extend to the opposite side of the plane 10 from the rear tower contact lobes 11. The tying tabs may feature one or more attachment holes 14.

The front clamping component 9 comprises two front tower contact lobes 16 which extend perpendicular from the main plane 15 of the front clamping component 9 and extend axially toward the rear clamping component 8 when the mounting clamp 2 is in its pre-assembled state. The front tower contact lobes 16 feature a notch 17 configured to contact and grip the tower structure to which the mounting clamp 2 is attached. The front clamping component 9 also features mounting tabs 18 located on each end of the front clamping component 9. The mounting tabs 18 are configured at a 90 degree angle from the main plane 15 of the front clamping component 9 and extend to the opposite side of the plane 15 from the front tower contact lobes 16. The mounting tabs 18 may feature one or more attachment holes 19 as well as a tilt adjustment slot 20.

The front and rear clamping components both feature a plurality of attachment holes on their main planes 10, 15 and are preferably connected through a plurality of bolts 21 and nuts 22.

The mounting clamp 2 also comprises a U-bracket 23 and a plate 24. The U-bracket 23 is preferably oriented such that the U shape is upright. The U bracket 23 may be pivotably bolted to the mounting tabs 18 via attachment holes 19 and the tilt adjustment slots 20 of the mounting tabs. The plate 24 is pivotably bolted to the lower portion of the U-bracket 23. The plate 24 is configured to attach to the side frames 3 of the mounting system 1.

The mounting clamp 2 is preferably configured such that when it is secured to the tower structure, the U-bracket 23 and the plate 24 may be pivoted without loosening the front and rear clamping components 9, 8 from the tower structure.

The mounting system 1 also features multiple side frames 3. The side frames 3 are generally rectangular in shape and are preferably made of metal. The side frames are monolithic in structure and are preferably cut from single piece of steel plate so that there are no points where multiple pieces of material are joined together in forming a side frame 3. The frames are configured such that they are not solid, but feature cross members which form an X shape. The side frames 3 are generally oriented such that their main plane 25 is vertical. The side frames also feature multiple mounting tabs 26 situated on opposing sides of the side frame 3. The mounting tabs 26 are configured at a 90 degree angle from the main plane 25 of the side frame. The side frames 3 may also feature a plurality of holes configured for attaching the face members 4 or plate 24 from the mounting clamp 2.

The mounting system 1 may also features multiple face members 4. The mounting system preferably has two face members. The face members 4 are generally oriented horizontally. The face members preferable have a right angled cross section and are preferably made of metal. Each face member is preferably made from a single, monolithic piece of metal. The face members may also feature a plurality of holes configures for attaching attachment members 6 and side frames 3.

The mounting system 1 may also feature one or more bracing arms 5 configured to attach to attach to a face member 3 of the mount system and either the tower structure or to a mounting clamp 2 of an adjacent mounting system. The bracing arms 5 are preferably made of metal and may be solid or hollow and may have a circular, square, rectangular or angled cross section. The preferred configuration, however, is a circular tube.

The mounting system 1 may additionally feature a plurality of attachment members 6 which are configured for the attachment of antennas and related equipment to the mounting system. The attachment members are generally oriented vertically. The attachment members 6 may be rigidly attached to the face members such that each attachment member 6 is attached to two face members 4 and are configured such that the ends of the attachment member 6 extend beyond the face member 4. The attachment members 6 are preferably made of metal and may be solid or hollow and may have a circular, square, rectangular or angled cross section. The preferred configuration, however, is a circular tube.

In the preferred embodiment, to use the mounting system 1, a mounting clamp 2 in the pre-assembled state is attached to the corners of two side frames 3 such that the plate 24 of the mounting clamp is attached to the mounting tab 26 of the side frame. A second mounting clamp 3 is attached to the side frames 3 via the same method at the corners directly adjacent to and below the corners attached to the first mounting clamp. A face member 4 is then attached to the remaining upper corners of the side frames 3. A second face member is then attached to the remaining lower corners of the side frames 3. The face members 4 are attached to the side frames such that each face member connects to both side frames via their mounting tabs 26 and such that the face members are oriented generally horizontally. Then, one or more attachment members 6 are attached to the face members 4 such that each attachment member 6 is attached to both face members 4 and oriented perpendicularly to the face members 4. A bracing arm 5 may be attached to one or both face members 4 such that an end of the bracing arm 5 is attached at a location proximate the face member's attachment to a side frame 3. The other end of the bracing arm may be attached to the tower structure of to a mounting clamp of an adjacent mounting system. The assembled mounting system is then attached to the tower structure by attaching the mounting clamps to the tower member such that the tower member is held by the contact lobes 11,16 of the front and rear clamping components, 8, 9.

The preferred embodiment is configured such that the mounting system 1 may be used immediately adjacent to up to two more mounting systems on the same member. This configuration is specifically depicted in FIG. 2. The mounting systems are configured in a radial orientation about the same tower member and may be configured such that three mounting systems form a triangular configuration. When multiple mounting systems are configured as such, they may also utilize tying members 27. The tying members 27 are generally oriented horizontally. The tying members preferable have a right angled cross section and are preferably made of metal. Each tying member is preferably made from a single, monolithic piece of metal. The tying members may be rigidly attached to the tying members 13 or adjacent mounting clamps. In a configuration of three mounting systems, a total of six tying tabs may be used such that there are three connecting the upper mounting clamps and three connecting the lower mounting clamps.

Figure 4:
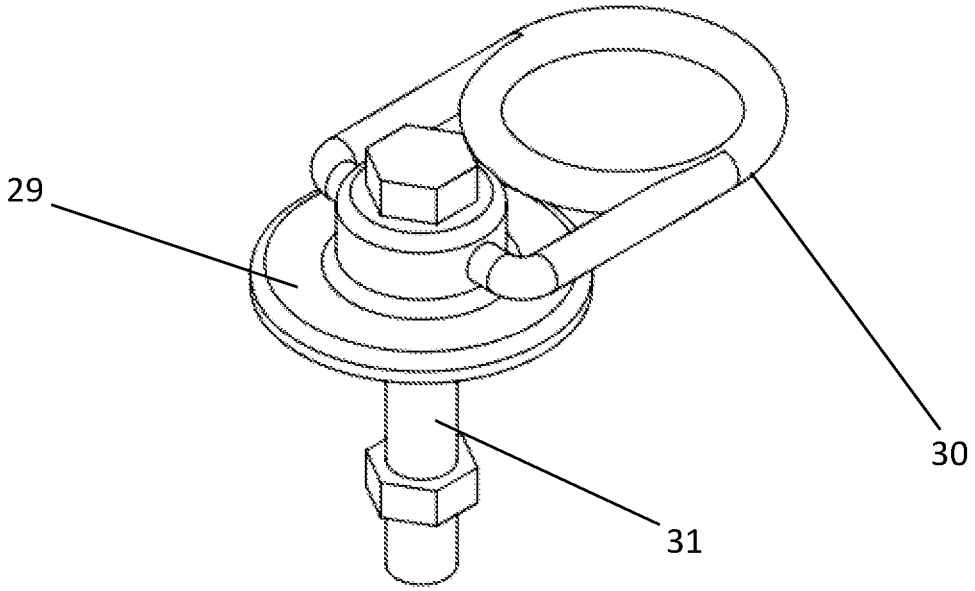
FIG. 4 is an isometric view of the safety anchor.
Figure 5:
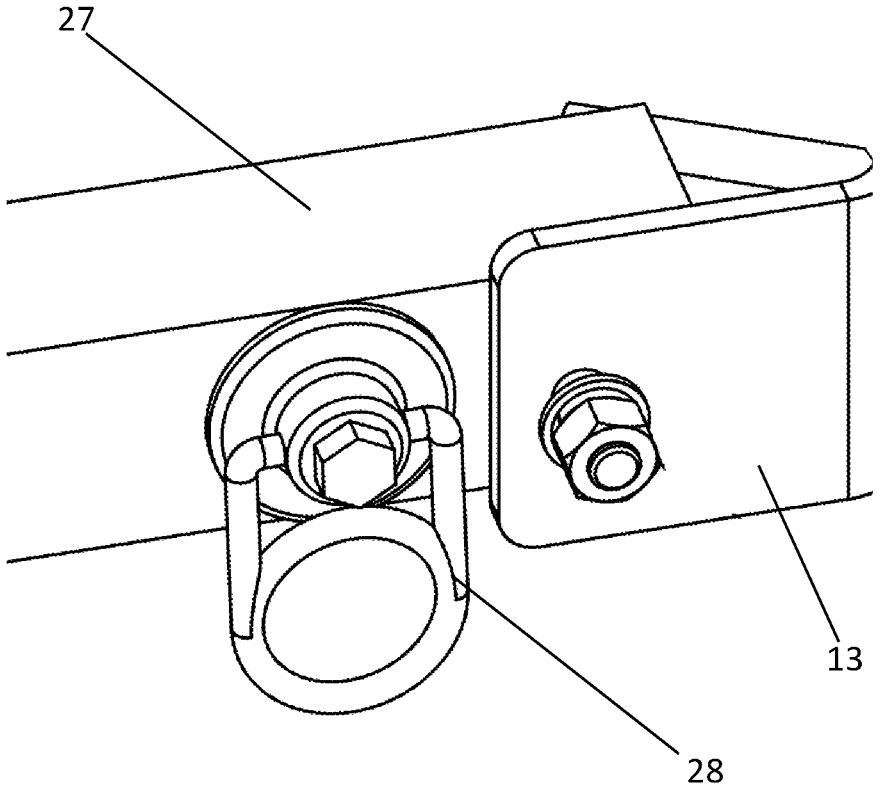
FIG. 5 is an isometric view of the anchor point attached to the tying member.

Referring to the drawings, FIGS. 4 and 5 depict an anchor point 28 configured to connect to the fall-arrest equipment of tower technicians. The anchor point 28 comprises an anchor base 29 which is generally flat, an anchor ring 30 which attached to the anchor base, and an anchor bolt 31 which may be configured to rigidly connect the anchor point 28 to the mounting system. The anchor ring 30 may also be integral with the anchor base. The preferred location for attaching the anchor point 28 is one of the tying members 27 or one of the tying tabs 13. The mounting point is preferably made of metal and is preferably configured to be able to support a working load of no less than 10,000 lbs.

Figure 6:
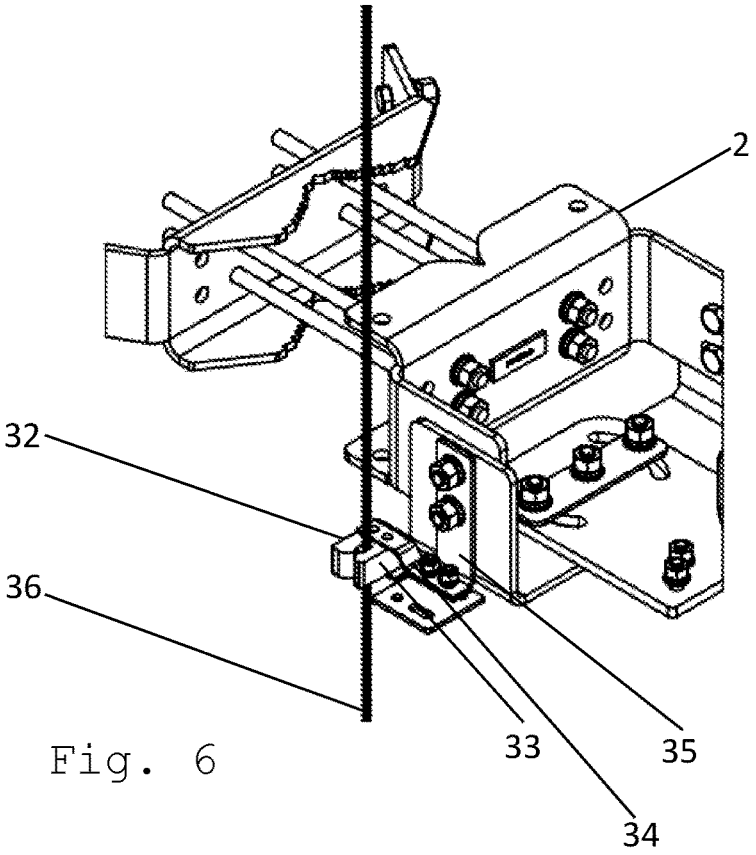
FIG. 6 is a right side isometric view of the mounting clamp with attached cable retainer.
Figure 7:
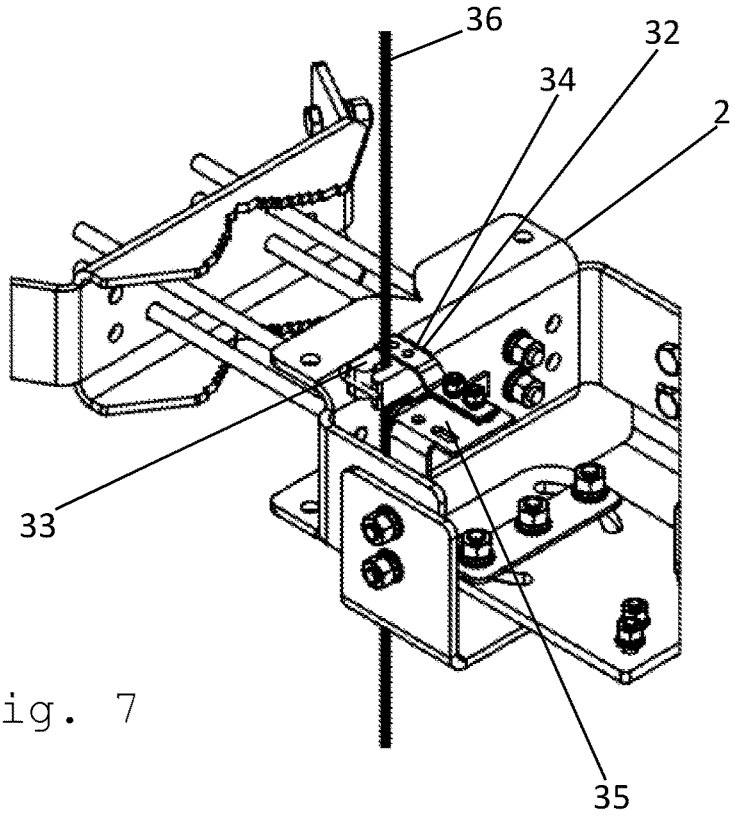
FIG. 7 is a right side isometric view of the mounting clamp with attached cable retainer.

Referring to the drawings, FIGS. 6 and 7 depict a cable guide 32 which may be attached to the mounting clamp 2. The cable guide may be comprise of two semi-rigid prongs 33 and an attached bracket 34. The cable guide 32 may be attached to the mounting clamp's U-bracket 23 on either the inboard or outboard side of the bracket. The cable guide 32 is preferably attached to the U-bracket via an L-bracket 35, but may also be attached via other structures known in the art. The prongs 33 may be oriented such that the ends are in contact with one another, but may be separated with little effort. The cable guide 32 is configured such that a technician's fall arrest cable 36 may be held proximate the mounting clamp 2 via being placed between the prongs 33 which hold the cable securely but such that it may be removed with minor force applied by the technician.

What is claimed is:

1. An antenna mounting system comprising:

a plurality of clamps, each said clamp comprising:

a rear clamping component, said rear clamping comprising a plurality of rear tower contact lobes, said rear tower contact lobes comprising a serrated notch, a plurality of tying tabs, and a plurality of attachment holes;

a front clamping component, said front clamping component comprising a plurality of front tower contact lobes, said front tower contact lobes comprising a notch, a plurality of mounting tabs, and a plurality of attachment holes;

a plurality of bolts configured to attach said rear clamping component to said front clamping component via said attachment holes in each respective clamping component;

a U bracket, which is pivotably attached to the mounting tabs of the front clamping component; and a plate which is pivotably attached to a lower portion of the U bracket;

a plurality of side frames, each said side frame comprising a main plane and a plurality of mounting tabs;

a plurality of face members.

2. The antenna mounting system as defined in claim 1 wherein the side frames further comprise cross members which form an X shape.

3. The antenna mounting system as defined in claim 1 further comprising a plurality of attachment members.

4. The antenna mounting system as defined in claim 1 further comprising a plurality of bracing arms.

5. The antenna mounting system as defined in claim 1 further comprising an anchor point.

6. The antenna mounting system as defined in claim 1 further comprising a cable guide.

7. The antenna mounting system as defined in claim 2 further comprising a plurality of attachment members.

8. The antenna mounting system as defined in claim 2 further comprising a plurality of bracing aims.

9. The antenna mounting system as defined in claim 2 further comprising an anchor point.

10. The antenna mounting system as defined in claim 2 further comprising a cable guide.

11. An antenna mounting system comprising:

a plurality of the individual antenna mounting systems as defined in claim 1 wherein each individual mounting system is configured adjacent to one or more additional individual antenna mounting systems; and a plurality of tying members configured to affix the individual antenna mounting systems to one another.

12. An antenna mounting system comprising:

a plurality of the individual antenna mounting systems as defined in claim 2 wherein each individual mounting system is configured adjacent to one or more additional individual antenna mounting systems; and a plurality of tying members configured to affix the individual antenna mounting systems to one another.

13. The antenna mounting system as defined in claim 11 further comprising a plurality of attachment members.

14. The antenna mounting system as defined in claim 11 further comprising a plurality of bracing arms.

15. The antenna mounting system as defined in claim 11 further comprising an anchor point.

16. The antenna mounting system as defined in claim 11 further comprising a cable guide.

17. The antenna mounting system as defined in claim 12 further comprising a plurality of attachment members.

18. The antenna mounting system as defined in claim 12 further comprising a plurality of bracing arms.

19. The antenna mounting system as defined in claim 12 further comprising au anchor point.

20. The antenna mounting system as defined in claim 12 farther comprising a cable guide.

* * * * *